United States Patent [19]

Wegner

[11] 4,195,429

[45] Apr. 1, 1980

[54] ELECTRICALLY OPERATED COPYHOLDER

[75] Inventor: John F. Wegner, Des Plaines, Ill.

[73] Assignee: Edanbob Corporation, Franklin Park, Ill.

[21] Appl. No.: 866,300

[22] Filed: Jan. 3, 1978

[51] Int. Cl.[2] ..... B41J 11/54

[52] U.S. Cl. ..... 40/356

[58] Field of Search ..... 40/352, 353, 354, 355, 40/356

[56] References Cited

U.S. PATENT DOCUMENTS

| | | | |
|---|---|---|---|
| 1,393,116 | 10/1921 | Guthridge | 40/356 |
| 1,905,834 | 4/1933 | Fensky | 40/356 |
| 2,763,241 | 9/1956 | Waggoner | 40/352 |
| 3,030,924 | 4/1962 | Friis-Hansen | 40/356 |
| 3,153,400 | 10/1964 | Mendels | 40/352 |
| 3,449,850 | 6/1969 | Eckert | 40/356 |

*Primary Examiner*—Louis G. Mancene
*Assistant Examiner*—Wenceslao J. Contreras
*Attorney, Agent, or Firm*—Emrich, Root, O'Keeffe & Lee

[57] ABSTRACT

An electrically operated copyholder is disclosed wherein a line guide extending transversely of copy matter supported on a face plate is removably mounted on an endless driving element, such as a belt, which is driven by a motor controlled by a typist, thereby to move the line guide automatically across the material to be copied line by line.

2 Claims, 6 Drawing Figures

ELECTRICALLY OPERATED COPYHOLDER

BACKGROUND OF THE INVENTION

Copyholders used by typists to support material to be copied have long been known, wherein a line guide member is magnetically mounted on the support for the matter to be copied, and is advanced or moved downwardly a line at a time manually by the typist.

Moving the line guide manually is time consuming, since it requires the typist to remove at least one hand from the typewriter keys, thereby interrupting the typing, when otherwise typing could be continued if the line guide were to be moved by suitable power means.

The aforesaid disadvantages of manually advancing the line guide member over the copy matter on a copyholder are obviated by the use of the present invention.

BRIEF SUMMARY OF THE INVENTION

The invention relates generally to copyholders wherein copy matter is supported on a face plate to be viewed and copied by a typist. More particularly the invention is directed to an improvement in such copyholders whereby the line guide member extending transversely of the face plate and which indicates to the typist the line of copy matter being copied, is caused to advance by electrically controlled means rather than manually.

The invention is more specifically directed to a novel form of drive means to which the line guide is attached, which drive means are driven by electrically operated motor means controlled by a foot pedal operated by the typist, so that it is unnecessary for the typist to remove his or her hands from the keys of the typewriter to move the line guide down to the next line to be copied.

It is therefore a principal object of the present invention to provide a copyholder wherein the line guide member may be moved by the typist without removing the hands from the typewriter keys.

Another object is to provide a copyholder wherein a line guide member is moved by electrically operated means controlled by the typist.

A further object of the invention is to provide a copyholder wherein the line guide member is moved by operation of an electric motor controlled by a suitable foot pedal.

A still further and more specific object of the invention is to provide a copyholder wherein an endless drive member, such as a metallic belt, is driven by an electric motor controlled by the typist, and to which the line guide member is attached, whereby operation of the motor will drive the drive member and line guide attached thereto to position the line guide at the desired location on the copyholder.

Other objects and advantages of the invention will appear more fully hereinafter as the description proceeds.

DETAILED DESCRIPTION OF THE INVENTION

Figures 1, 2, 3, 4, 5, 6:
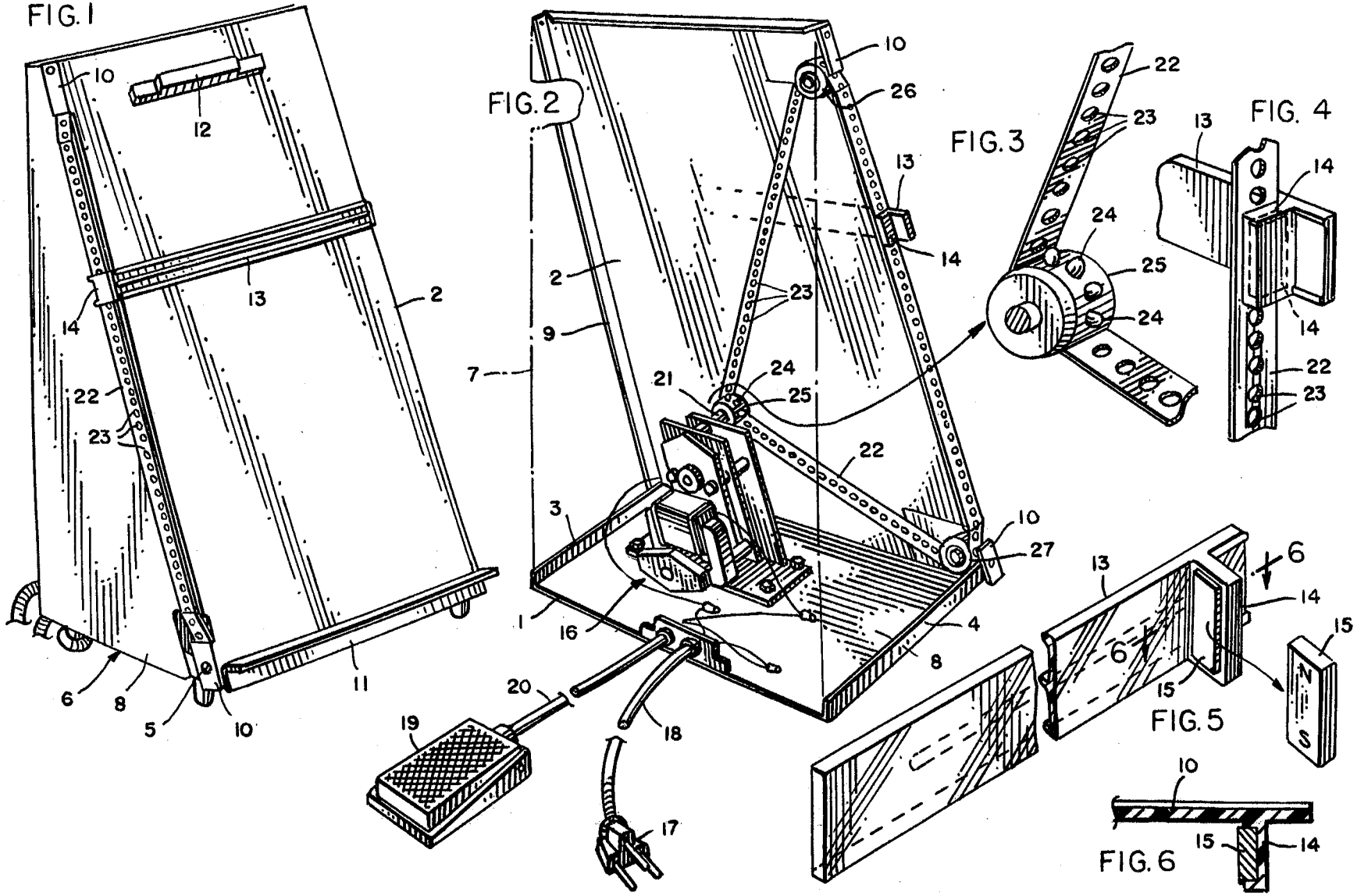
FIG. 1 is a front perspective view of a copyholder embodying the preferred form of the present invention.
FIG. 2 is a rear perspective view of the device of FIG. 1 with the enclosure therefore in phantom and showing the motor and drive means for the line guide member.
FIG. 3 is a fragmentary enlarged perspective view of a portion of FIG. 2 showing the preferred form of driving connection between the motor and the endless drive member.
FIG. 4 is an enlarged fragmentary perspective view showing the preferred form of means for mounting the line guide on the drive member.
FIG. 5 is a fragmentary rear perspective view of the line guide showing the mounting of the magnetic means which is used to secure the line guide on a metallic endless drive member.
FIG. 6 is a fragmentary horizontal sectional view through the magnet end of the line guide and taken substantially along the plane of line 6—6 of FIG. 5.

Referring now more particularly to the drawing and especially to FIGS. 1 and 2 thereof, there is illustrated a base member 1 to which is attached the face plate 2 on which the copy matter is supported.

The base member 1, at each end thereof is provided with the upstanding flanges 3 and 4. The face plate 2 is mounted on the forward ends of the flanges 3 and 4 by suitable means such as the screws 5. A closure member generally indicated by the numeral 6 comprises the back 7 and sides 8. Since it is preferable that the face plate be inclined when in use, the sides 8 are generally triangular in shape so that these sides, together with the back 7 cooperate with the face plate 2 to enclose the drive means which are utilized to advance the line guide member.

The face plate 2 is provided at each side thereof with the rearwardly extending flanges 9 and 10. The screws 5 extend through the lower ends of the flanges 9 and 10 and the forward ends of the flanges 3 and 4 for mounting the face plate in position for use.

At the lower end of the face plate 2 there is provided the usual angular support member 11 for supporting the bottom of the copy matter. The customary paper holder 12 is also provided for the purpose of holding the upper part of the copy matter in place against the face plate. As is customary, this paper holder is provided with a magnet so that it may be easily applied to the copy matter and held in place by reason of the face plate being metallic.

The line guide member 13 may also be of the usual and well known construction wherein one end thereof has a portion 14 extending rearwardly and within which the magnet 15 is secured. In the manually operated copyholders the line guide 13 is magnetically held in place on the face plate and may be moved over the copy matter line by line manually.

The present invention, being directed to electrically controlled means for advancing the line guide, is provided with a motor generally indicated by the numeral 16 and which is preferably mounted on the base member 1 within the enclosure. The motor is electrically operated and may be connected to a source of electrical current by means of the plug 17 and cord 18.

The motor is controlled by switch means (not shown) which are actuated by pressure of the typist's foot on the foot pedal 19, which is also connected to the motor 16 through the cable 20. The electrical connections are such that when the foot pedal 19 is depressed, a switch will be actuated to run the motor 16.

Gear reduction means may be connected to the shaft of the motor and to the drive shaft 21 (FIG. 2) so that when the foot pedal 19 is depressed the shaft 21 will rotate at a relatively low speed.

An endless drive member 22 is provided, which is driven by the motor 16, and to which the line guide member 13 may be attached, so that movement of the endless drive member will carry with it the line guide.

It will be evident that various means may be provided between the endless drive member and the motor so that when the motor is activated the endless drive member will be moved. In the present instance, however, the preferred form of the invention utilizes a series of perforations 23 throughout the length of the drive member 22, and these perforations are adapted to receive the teeth 24 on the toothed wheel 25 mounted on the shaft 21. The toothed wheel 25 may take the form of a cog wheel as shown.

An upper pulley 26 is mounted on the rear of the face plate 2 and a lower pulley 27 is mounted on the rear of the face plate near the lower end thereof. The endless drive member or belt 22 extends around the toothed wheel to receive the teeth 24 thereon, and it also extends around the upper pulley 26 and lower pulley 27 through suitable openings in the flange 10, so that it will extend along the outer surface of the flange 10. Thus, when the motor is activated and the wheel 25 is caused to rotate, the endless drive member 22 will be driven and moved in a suitable direction along the surface of the flange 10.

The line guide member 13 is suitably secured or attached to the endless drive member so that movement of the drive member will also advance the line guide. It is preferable that the drive member 22 be metallic so that the magnet 15 in the line guide may be used to removably attach the line guide to the drive member. It will be evident that the endless drive member can also be formed of other material and the line guide can be mounted thereon by any other suitable means.

In operation, the typist may view the copy matter supported on the face plate and copy it line for line and may advance the line guide downwardly merely by applying pressure on the foot pedal 19, thereby increasing the efficiency and time involved by making it unnecessary to remove the hands from the typewriter keys to advance the line guide manually.

Although the present invention has been described with reference to the preferred embodiments of the present invention, many modifications and alterations may be made within the spirit of the present invention.

I claim:

1. An electrically operated copyholder comprising, (a) a base support member, (b) a face plate extending upwardly from said base support member adapted to have copy matter supported thereon for viewing and copying by a typist, (c) a rearwardly extending flange member along at least one side of said face plate and provided with openings adjacent the upper and lower ends thereof, (d) a motor mounted on said base support member having a rotatable toothed wheel associated therewith and driven thereby, (e) a flat metallic endless drive belt having perforations therethrough extending around said toothed wheel and through said openings in said flange member, whereby the portion of said drive member between said openings will be exposed and will lie along the outer surface of said flange member and be driven by said motor, (f) a line guide member extending transversely of said face place and adapted to be moved with respect to the lines on the copy matter, (g) one end of said line guide member extending rearwardly therefrom and provided with a magnet thereon, and (h) said magnet being in contact with said drive member to support magnetically said line guide member thereon, whereby actuation of said motor will move said drive member and said line guide member, and yet said line guide member may be readily removed from said drive member for manual replacement thereon after completing the downward movement thereof.

2. An electrically operated copyholder comprising, (a) a base support member, (b) a face plate extending upwardly from said base support member adapted to have copy matter supported thereon for viewing and copying by a typist, (c) a rearwardly extending flange member along at least one side of said face plate and provided with openings adjacent the upper and lower ends thereof, (d) a motor mounted on said base support member having a rotatable shaft associated therewith and driven thereby, (e) a flat metallic endless drive belt having perforations therethrough and extending around said shaft and through said openings in said flange member, whereby the portion of said drive belt between said openings will be exposed and will lie flat along the outer surface of said flange member, (f) a toothed wheel on said shaft adapted to have the teeth thereon received in the perforations on said belt, whereby actuation of said motor will drive said belt, (g) a line guide member extending transversely of said face plate and adapted to be moved with respect to the lines on the copy matter, (h) one end of said line guide member extending rearwardly therefrom and provided with a recess therein, (i) a magnet removably mounted in said recess and adapted to be placed in contact with said drive belt to support said line guide member thereon, whereby movement of said belt will move said line guide member therewith, and yet said line guide member may be readily removed from said belt for manual replacement thereon after completing the downward movement thereof.

* * * * *